US008119981B2

(12) United States Patent
Powell

(10) Patent No.: US 8,119,981 B2
(45) Date of Patent: Feb. 21, 2012

(54) MASS SPECTROMETER

(75) Inventor: Eliot Powell, Staffordshire (GB)

(73) Assignee: Micromass UK Limited, Manchester (GB)

( * ) Notice: Subject to any disclaimer, the term of this patent is extended or adjusted under 35 U.S.C. 154(b) by 206 days.

(21) Appl. No.: 12/474,597

(22) Filed: May 29, 2009

(65) Prior Publication Data

US 2010/0301208 A1 Dec. 2, 2010

(51) Int. Cl.
*H01J 49/00* (2006.01)

(52) U.S. Cl. ..... 250/281; 250/282; 250/288

(58) Field of Classification Search ..... 250/281
See application file for complete search history.

(56) References Cited

U.S. PATENT DOCUMENTS

| | | | | |
|---|---|---|---|---|
| 5,442,157 | A | 8/1995 | Jackson | |
| 7,723,700 | B2 * | 5/2010 | Horsky et al. | 250/429 |
| 2010/0025576 | A1 * | 2/2010 | Adams | 250/288 |

FOREIGN PATENT DOCUMENTS

| | | | |
|---|---|---|---|
| EP | 0488371 | A2 | 6/1992 |

OTHER PUBLICATIONS

International Search Report for PCT/GB2010/050927, Forms PCT/ISA/220/210, dated Oct. 5, 2010.

* cited by examiner

*Primary Examiner* — Phillip A Johnston
(74) *Attorney, Agent, or Firm* — Jamie H. Rose

(57) ABSTRACT

A fault detection system for protecting a mass spectrometer from the effects of temperature extremes. The system comprises an ion block, a thermal source for providing thermal energy to the ion source block, a temperature sensor providing a reading for the temperature of the ion source block, a temperature regulation means for controlling the thermal source in dependence of the reading and a control system for monitoring the temperature change produced by the energy source. The control system is adapted to monitor the rate of change of the reading provided by the temperature sensor relative to the thermal energy provided to the ion block.

15 Claims, 5 Drawing Sheets

MASS SPECTROMETER

The present invention relates to the field of mass spectrometry.

BACKGROUND ART

In mass spectrometers ion sources are required to be heated up to high temperatures in order to provide optimum performance from the ion source. Typically an ion source block may be at temperatures as high as 150° c.

In order to attain these temperatures, a heater is required within the ion source block. A sensor is also placed in the ion source block so as to measure the temperature and prevent overheating.

Mass spectrometers are expensive instruments that are in constant use in many laboratories. Powerful heaters are desired to raise the temperature in the ion source up to the desired level as quickly as possible and therefore limit down time of the instrument. Therefore it would be desirable to provide a very powerful heater.

In the event of specific failure modes of a temperature sensor, powerful heaters in the source block may increase the temperature of the source to dangerously high levels at which damage may be caused to the mass spectrometer and to their users. In such circumstances, the mass spectrometer could incorrectly indicate that the temperature in the ion source chamber is below the actual temperature. This results in the heater continuing to heat the ion source, which potentially results in severe damage to the instrument requiring expensive repairs to the instrument.

It is therefore desirable to have a method of identifying faults in the source heater assembly mechanism so as to ensure the source heater will not cause severe damage to the mass spectrometer.

SUMMARY OF THE INVENTION

This invention provides a fault detection system for protecting a mass spectrometer from the effects of temperature extremes, the system comprising:

an ion source block, a thermal source for providing thermal energy to said ion source block, a temperature sensor providing a reading for the temperature of said ion source block, a temperature regulation means for controlling said thermal source in dependence of said reading provided by the temperature sensor and, a control system for monitoring the temperature change produced by said energy provided by said thermal source, and wherein said control system is adapted to monitor the rate of change of said reading provided by said temperature sensor relative to the thermal energy provided to said ion block by said thermal source.

According to a feature of the invention, the thermal source may be a heater.

According to another feature of the invention, said control system may have diagnostic ability so that so that the nature of an indicated fault can be identified According to a further feature of the invention, a determinative threshold value may be assigned to the rate of change of said reading provided by said temperature sensor relative to the thermal energy provided to said ion block by said thermal source According to a still further feature of the invention, said determinative threshold value may be defined by the value x below the lowest rate of change of temperature of the ion source block.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENT

Figure 1:
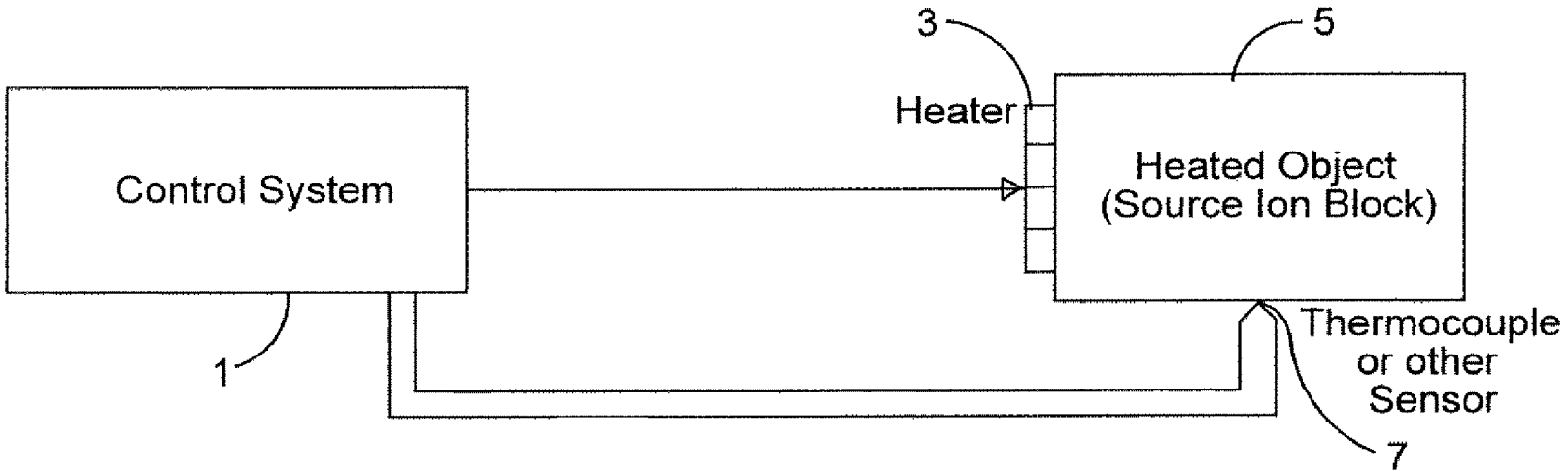
FIG. 1 is a drawing of a typical heater control assembly according to the prior art.

FIG. 1 illustrates a prior art heater control system. The known control system consists of a temperature regulation means (1), a heater (3) and a ion source block (5) with a thermocouple sensor (7) measuring the temperature of the ion source block. Should the sensor fail and give a false low indication of temperature, the control system will normally apply maximum power to the heater indefinitely which may result in overheating and consequent damage to the mass spectrometer.

Figure 2:
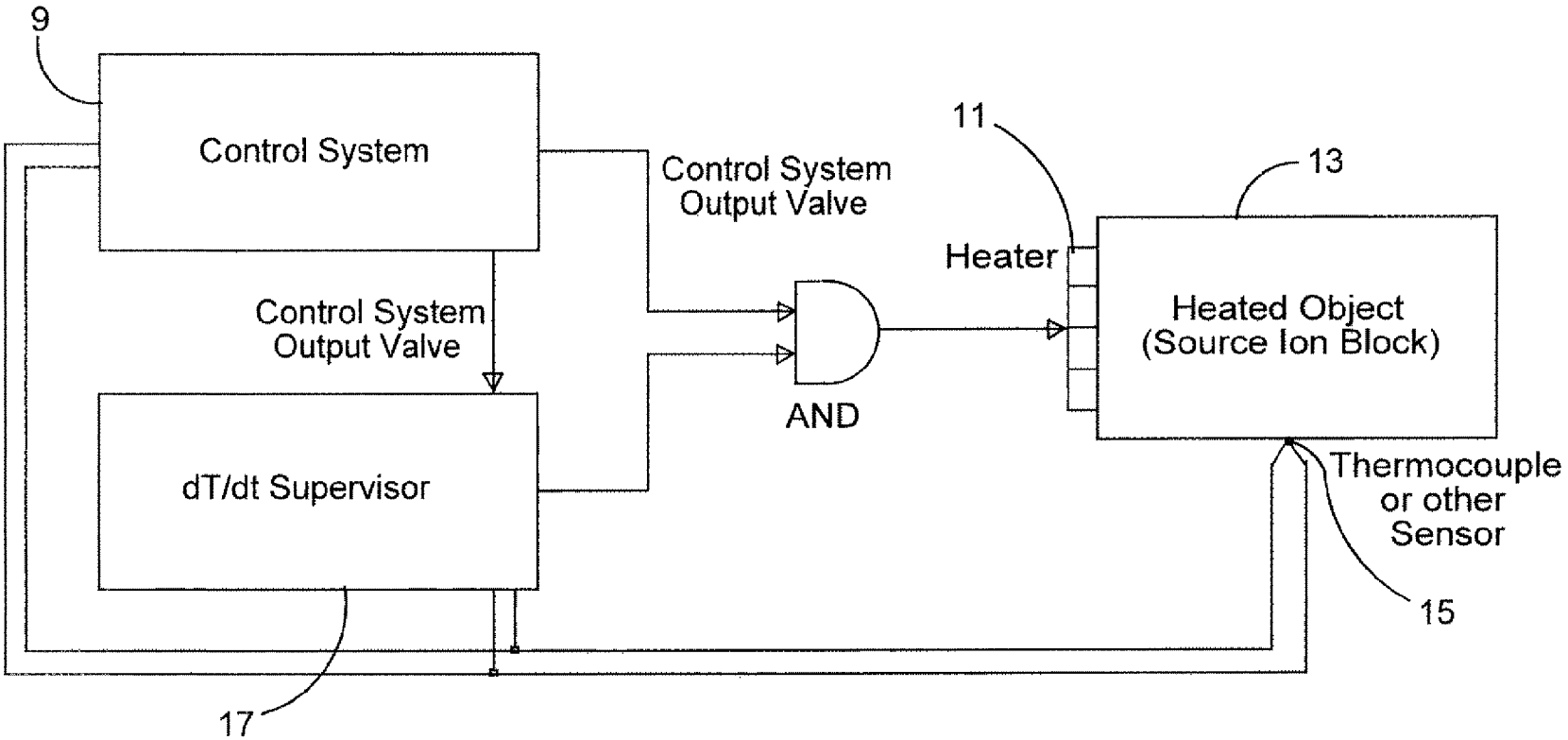
FIG. 2 is a schematic drawing of a heater assembly according to the present invention.

FIG. 2 illustrates a heater control system in accordance with the present invention. The control system consists of a temperature regulation means (9), a heater (11) an ion source block (13) with a thermocouple sensor (15) measuring the temperature of the ion source block and a control system (17) for monitoring the temperature change to the ion source block produced by the heater. When the system is activated, the control system (17) by default enables the heater (11). The available heating power is large and so under all normal circumstances the temperature regulation means will allow the heater to be switched on and the ion source block should undergo a large and measurable rate of change of temperature.

The control system starts monitoring only when the temperature regulation means allows the heater to be switched on. Once activated the control system begins to measure the rate of change of temperature of the heated ion source block. If the rate of change of temperature is below a given number X ° $C.s^{-1}$ for y seconds, the control system will conclude that there is a system fault such as the thermocouple or the sensor not being in good thermal contact with the ion source block, or that there is a short circuit across the thermocouple. The control system will then disable the heater. The heater remains disabled for another programmable period of time, z seconds. With knowledge of the system parameters this time period can be set to be sufficient for the heated ion source block to return to approximate equilibrium with the local ambient temperature. Once this time period has elapsed the system can attempt to restart in the event that the fault has been removed.

Figure 3:
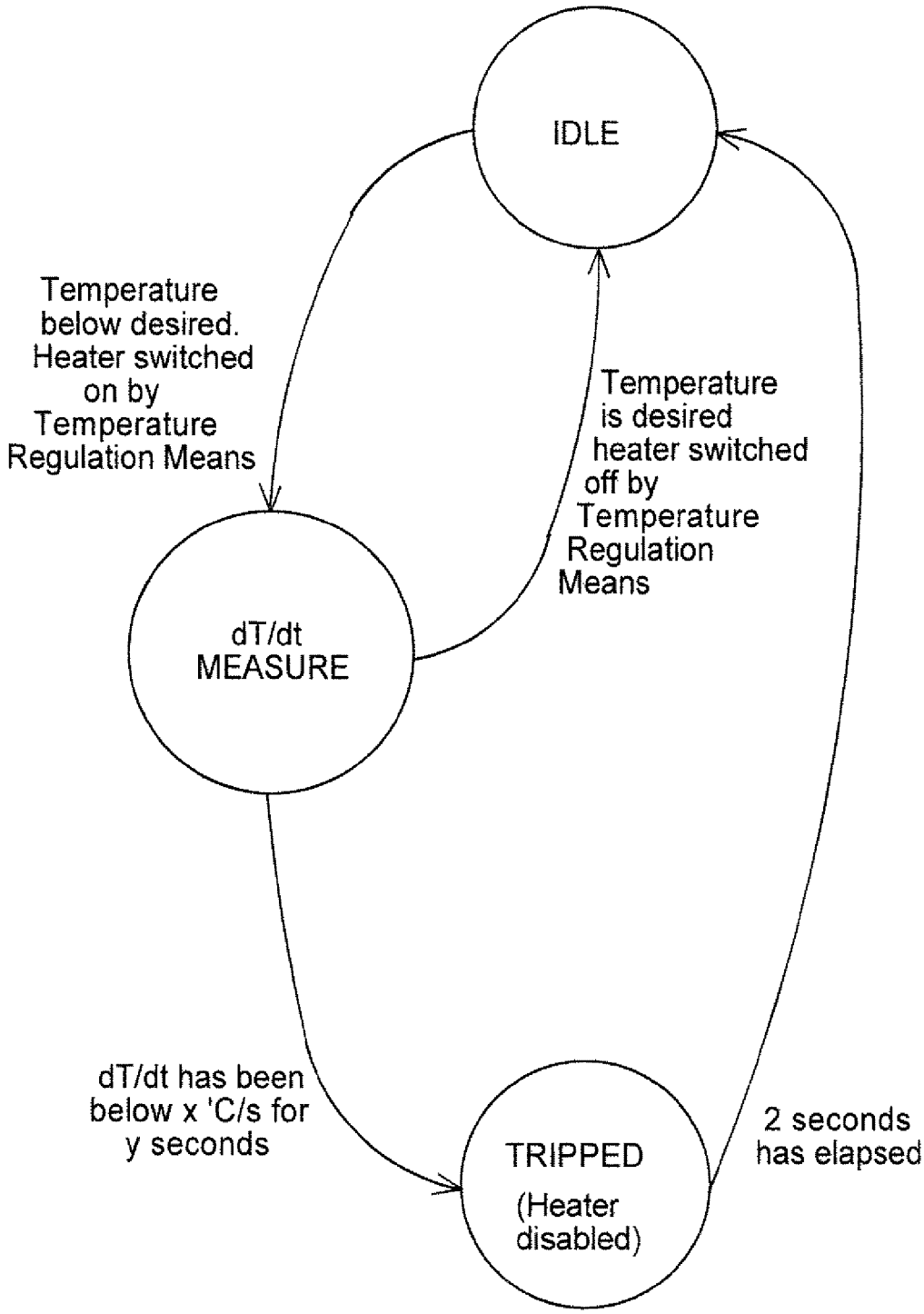
FIG. 3 is a schematic of the process associated with the present invention.

FIG. 3 is a state transition diagram illustrating the process of the invention.

Figure 4:
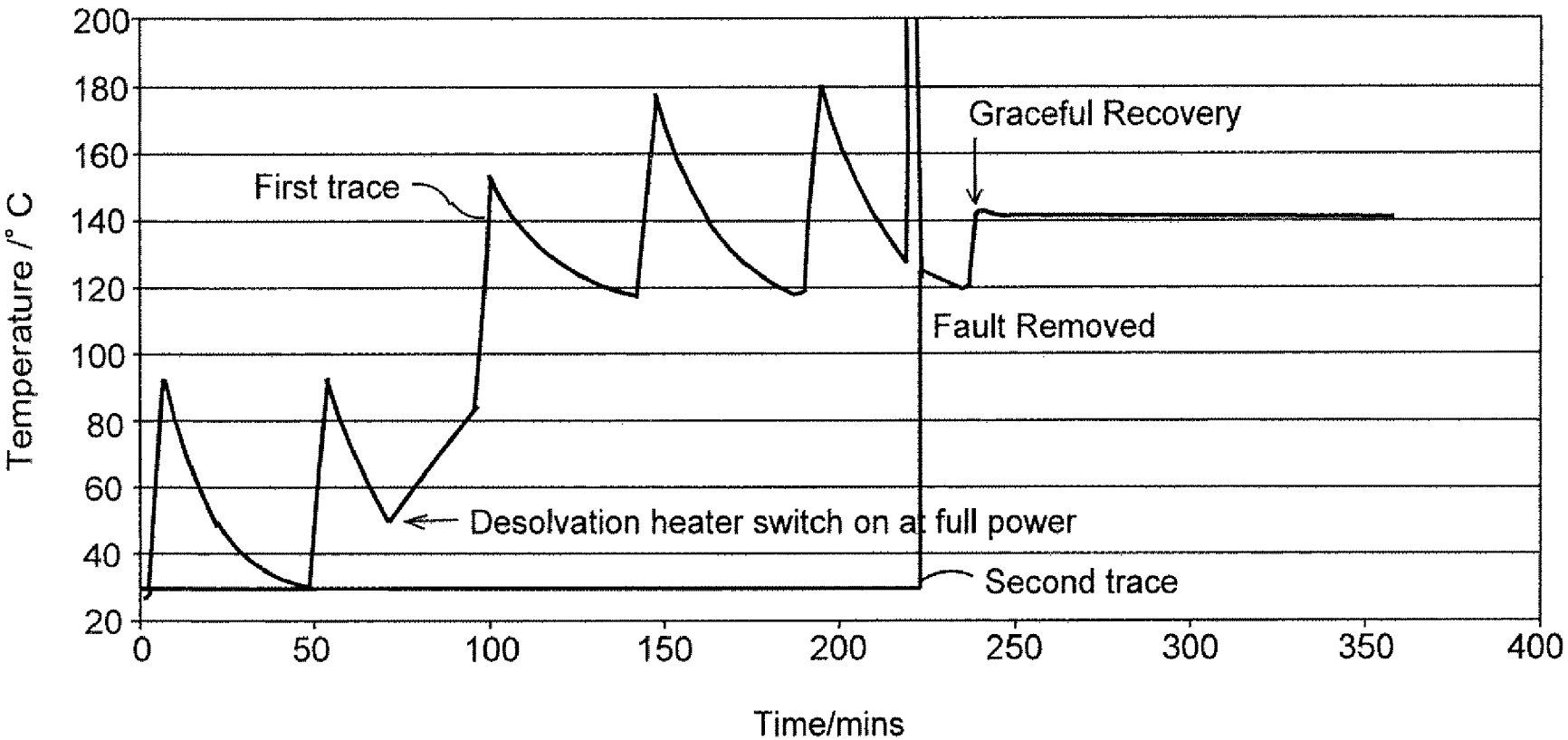
FIG. 4 is a graph illustrating the method of the present invention in the circumstance of an error in the temperature sensor.

FIG. 4 illustrates the trip mechanism and error identification in accordance with the invention. At time 0 the thermocouple in the ion source block has been disconnected from the control electronics and connected into a datalogger. The first trace shows the reading from this datalogger. The control electronics is connected to a thermocouple which is simply at ambient temperature.

The rapid rise of temperature shown between t=0 and t=5 is the result of the control electronics applying full power to the ion block heater. After approximately 5 minutes the protection mechanism is activated because the rate of change of temperature as measured by the control electronics is close to zero as the thermocouple connected to the control electronics is measuring ambient temperature which is substantially constant.

At t=50 the system has allowed enough time for the ion source block to cool and an attempt is made to regain control should the fault now have been removed.

At t=70 the switching on of the desolvation heater simply raises the local ambient temperature to about 120° C. from about 30° C.

The system has several attempts to regain control until at about t=220 the thermocouple measuring the source ion block is reconnected to the control electronics. It remains connected to the datalogger. The heater remains off until the current cooling down period has finished. At about t=240 the system successfully leaves the error state and the ion source block is correctly regulated to 140° C.

The second trace shows the temperature which the control electronics "sees". After t=220 there is no further trace line because after this point it sees the real temperature i.e. the first trace line.

Figure 5:
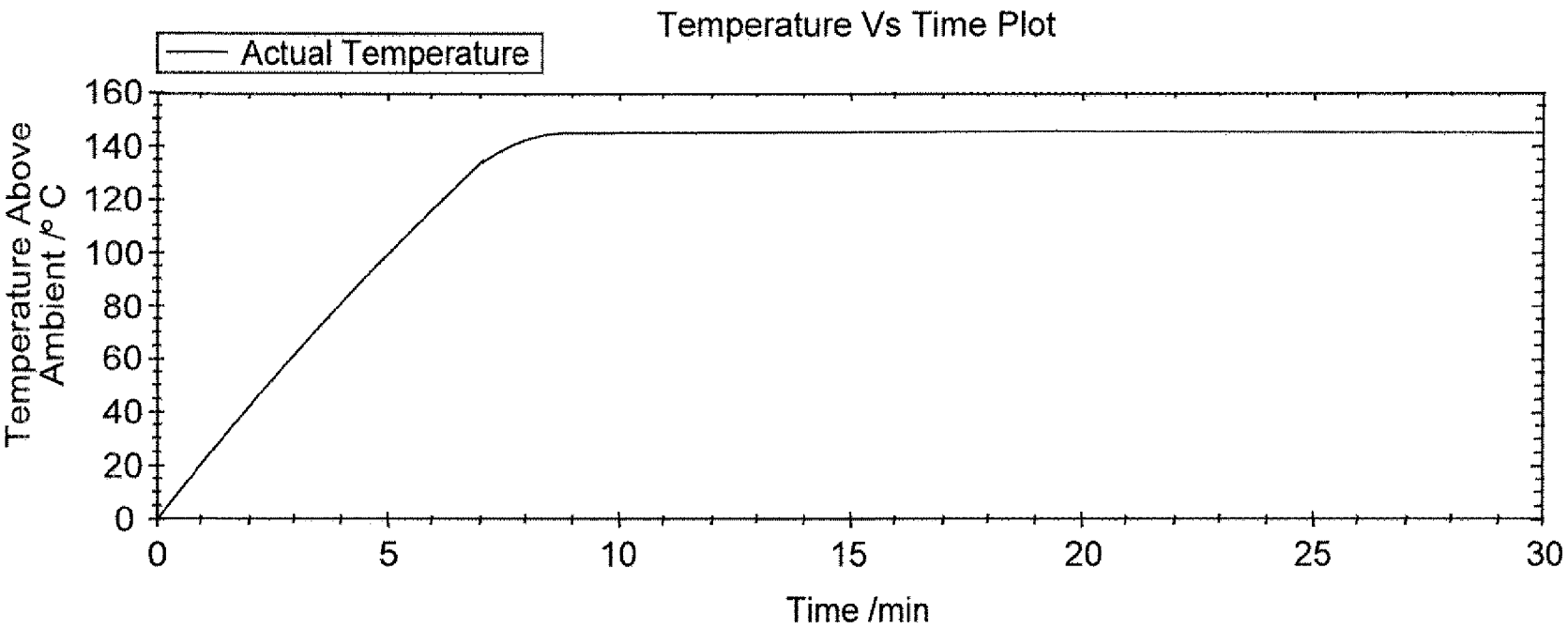
FIG. 5 is a graph of temperature against time in the event that the temperature sensor is in full working order.

FIG. 5 is a graph of temperature against time in the situation where the temperature sensor is in full working order. It should be apparent from this that the heater will continue until the source has reached optimum temperature at which time the heater is automatically switched off by the control system.

The value of X may be determined by measuring the rate of change of temperature when the heater is active under all operating conditions. If the heater is active and the ion block is cold it heats more rapidly than when the heater is active and the ion block is already partly warm. Therefore the actual rate of change of temperature is measured at the maximum operating temperature, because this is the case where the rate of change of temperature is lowest. A series of experiments may determine under which operating conditions the rate of change of temperature is lowest. The lowest rate of change of temperature was determine to be X ° C./min. The system may be set to trip if the rate of change of temperature is less than X/2° C./min, so there is little chance of false tripping. The skilled person would appreciate any value below X ° C. would be suitable The value of y, may be determined by first determining the maximum local ambient temperature. With the desolvation heater on full and with maximum desolvation gas the value for the maximum local ambient temperature was approximately A ° C. In experiments to determine x, the maximum rate of change of temperature of the ion source was also determined. This value was found to be approximately C ° C. per minute. It is desired to prevent the source ion block exceeding B ° C. So the maximum time the heater active is (B−A)/C=D minutes. A value below D minutes should therefore be selected.

The value of z may be determined by a series of experiments to find the slowest cooling rate that could ever happen when the heater is inactive. The slowest cooling rate had a time constant of F minutes. A standard engineering rule of thumb is that something has reached 90% of it's final value after 2.2 F. The system will never exactly return to ambient temperature, and the vast majority of any cooling has occurred after 2.2 F. The skilled person would appreciate that many other values of z could be used and the system remain effective.

Another method comprises finding the ratio between the slowest known rate of cooling (approx J ° C. per min) and the highest rate of heating (approx K ° C. per min). This ratio is k/j. Accordingly, under fault conditions the heater must be off for k/j longer than it is active.

The active time, y, is 4 minutes so the inactive time or tripped time must be at least 4 k/j minutes.

It would be apparent to the person skilled in the art that the process may equally be applicable for extremely low temperatures in the same way.

OTHER EMBODIMENTS

It will be apparent that various modifications may be made to the particular embodiments discussed above without departing from the scope of the invention.

The invention claimed is:

1. A fault detection system for protecting a mass spectrometer from the effects of temperature extremes, the system comprising:

an ion source block, a thermal source for providing thermal energy to said ion source block, a temperature sensor providing a reading for the temperature of said ion source block, a temperature regulation means for controlling said thermal source in dependence of said reading provided by the temperature sensor and, a control system for monitoring the temperature change produced by said energy provided by said thermal source, and wherein said control system is adapted to monitor the rate of change of said reading provided by said temperature sensor relative to the thermal energy provided to said ion block by said thermal source.

2. A fault detection system as claimed in claim 1 wherein said thermal source is a heater.

3. A fault detection system as claimed in claim 1 wherein said control system has diagnostic ability so that so that the nature of an indicated fault can be identified.

4. A fault detection system as claimed in claim 1 wherein a determinative threshold value is assigned to the rate of change of said reading provided by said temperature sensor relative to the thermal energy provided to said ion block by said thermal source.

5. A fault detection system as claimed in claim 4 wherein said determinative threshold value is defined by the value x below the lowest rate of change of temperature of the ion source block.

6. A fault detection system for protecting a mass spectrometer from the effects of temperature extremes, the system comprising:

an ion source block, a thermal source for providing thermal energy to said ion source block, a temperature sensor providing a reading for the temperature of said ion source block, a temperature regulation means for controlling said thermal source in dependence of said reading provided by the temperature sensor, a control system for monitoring the temperature change produced by said energy provided by said thermal source, wherein said control system is adapted to identify a fault if the rate of change of said reading provided by said temperature sensor relative to the thermal energy provided to said ion block by said thermal source deviates from a determinative threshold value.

7. A fault detection system as claimed in claim 6 wherein said control system is adapted to identify a fault if the rate of change of said reading provided by said temperature sensor relative to the thermal energy provided to said ion block by said thermal source deviates from the determinative threshold value for a predetermined period of time.

8. A fault detection system as claimed in claim 6 wherein said control system is adapted to identify a fault if the rate of change of said reading provided by said temperature sensor relative to the thermal energy provided to said ion block by said thermal source is below the determinative threshold value.

9. An ion source block temperature control system for a mass spectrometer, the system comprising a fault detection system according to claim 6, wherein said control system is adapted to cause the temperature regulation means to disable the thermal source if said rate of change of said reading provided by said temperature sensor relative to the thermal energy provided to said ion block by said thermal source deviates from said determinative threshold value.

10. A fault detection system as claimed in claim 9 wherein said control system is adapted to cause said temperature regulation means to re-enable said thermal source after a predetermined time period has elapsed following said disabling of said thermal source.

11. A method of identifying a fault in an ion source block heating system, the method comprising the steps of:

heating an ion source block;

measuring a rate of change in temperature of the ion source block during said heating stage; and identifying a fault if the rate of change in temperature measured during said heating stage deviates from a determinative threshold value.

12. A method of identifying a fault in an ion source block heating system as claimed in claim 11 wherein said fault is identified if said rate of change of temperature measured during said heating stage deviates from the determinative threshold value for a predetermined period of time.

13. A method of identifying a fault in an ion source block heating system as claimed in claim 11 wherein said fault is identified if said rate of change of temperature measured during said heating stage is below the determinative threshold value.

14. A method of protecting an ion source block from the effects of temperature extremes, the method comprising identifying a fault in accordance with the method of claim 11 and disabling the heating of the ion source block on detection of said fault.

15. A method of protecting an ion source block as claimed in claim 14 further comprising re-enabling said heating of the ion source block after a predetermined time period has elapsed following said disabling of said heating of the ion source block.

* * * * *